United States Patent [19]

Blanchard

[11] Patent Number: 5,054,666

[45] Date of Patent: Oct. 8, 1991

[54] BELT DISPLAY HANGER

[75] Inventor: Russell O. Blanchard, Zeeland, Mich.

[73] Assignee: Batts, Inc., Zeeland, Mich.

[21] Appl. No.: 586,898

[22] Filed: Sep. 24, 1990

[51] Int. Cl.[5] ..... A47G 25/18; A47G 25/28

[52] U.S. Cl. ..... 223/88; 223/95; 223/85; 223/87; D6/328

[58] Field of Search ..... 223/85, 88, 87, 95, 223/93, 90, 91, 96; 211/13, 113; 248/305; D6/315, 328

[56] References Cited

U.S. PATENT DOCUMENTS

| | | | |
|---|---|---|---|
| 2,531,894 | 11/1950 | Samuel | 223/96 |
| 2,855,132 | 10/1958 | Meeker et al. | 223/85 |
| 2,940,647 | 6/1960 | Clement | 223/85 |
| 2,985,346 | 5/1961 | Meeker et al. | 223/85 |
| 3,028,013 | 4/1962 | Cotey | 211/13 |
| 4,871,097 | 10/1989 | Blanchard et al. | 223/85 |
| 4,930,692 | 6/1990 | Smilow et al. | 223/85 |

FOREIGN PATENT DOCUMENTS

| | | | |
|---|---|---|---|
| 3537565 | 4/1987 | Fed. Rep. of Germany | 223/85 |

*Primary Examiner*—Werner H. Schroeder
*Assistant Examiner*—Bibhu Mohanty
*Attorney, Agent, or Firm*—Price, Heneveld, Cooper, DeWitt & Litton

[57] ABSTRACT

A hanger for displaying a belt with a garment includes an elongated body and a plurality of loops or straps joined to the body for receiving a belt. The loops simulate the belt loops on a pair of slacks, pants or on a skirt. An attachment arm mounts the hanger onto a garment hanger in the approximate area of the belt loops of the garment. The attachment arm may define a clip which snaps onto the garment hanger or a slot which receives the support hook of the garment hanger. In a further alternative, a pair of clips may be joined to the body to attach the belt display hanger to the garment waistband.

31 Claims, 5 Drawing Sheets

BELT DISPLAY HANGER

BACKGROUND OF THE INVENTION

The present invention relates to hangers and more particularly to a device for displaying an accessory such as a belt with a garment.

Garments such as pants, slacks or skirts are generally displayed at retail outlets on hangers. Typically, the hanger will engage the garment at the waistband and a plurality of garments are displayed on a rack. One garment hanger which is widely used is of the general type disclosed in U.S. Pat. No. 3,767,092 entitled GARMENT CLAMPING HANGER WITH SLIDABLE LOCKING CLIP and which issued on Oct. 23, 1973 to Garrison et al. As disclosed therein, the garment hanger includes an elongated main body having a generally I-beam shape in cross section and a pair of integral, hinged clamp members. The clamp members are biased together and locked by a generally U-shaped spring clip. The garment covers the front face of the hanger body when positioned in the clamps. As a result, the hanger does not detract from the visual presentation of the garment.

In many instances, a garment manufacturer will ship a pair of slacks, pants or the like with a belt threaded through the belt loops. The garment may be sold with a color coordinated accessory. Typically, the garments are shipped to the retailer on the garment hanger. If a retailer desires to combine a belt with the garment, the garment must be removed from the hanger. The belt must be threaded through the loop and the garment rehung. This process is time consuming. Problems are also encountered with rehanging the garments after they have been removed from the hangers by the customer. The customer may experience difficulty in applying the hanger due to interference with the belt. The retailer must spend time, therefore, rehanging the garments to improve the appearance of the display.

A need exists for a device or hanger which permits the ready display of a belt with a garment belt which overcomes the aforementioned problems.

SUMMARY OF THE INVENTION

In accordance with the present invention, a unique hanger or device is provided for displaying a belt with a garment in a visually pleasing manner. Essentially, the device includes an elongated body having belt mounting means thereon which removably receives a belt. Hanger attachment means are provided for securing the device to a garment hanger or to the garment in the approximate position of the garment belt loops.

In narrower aspects of the invention, a plurality of generally U-shaped straps or loop-like members are joined to the body to simulate the garment belt loops. In one form, the attachment means includes a pair of hinged arms having clips formed thereon which snap onto the garment hanger body. In another form, an arm or tab-like structure defines a slot or aperture which may be slipped over the garment hanger hook. In a still further form, a pair of hook like clips are included so that the device may be clipped onto the garment itself. The device may be molded integrally as a one-piece member in a simple two-piece mold. In the alternative, the device may be fabricated from sheet plastic or cardboard material which is die cut and folded to the appropriate configuration.

The device in accordance with the present invention permits a belt to be displayed with the garment. The belt may be shipped with the garment by the clothing manufacturer or readily added to the display by the clothing retailer. Interference problems with hanging the garment due to the presence of a belt are eliminated. The device presents the belt to the customer in an aesthetically pleasing fashion.

DETAILED DESCRIPTION OF THE PREFERRED EMBODIMENTS

Figure 1:
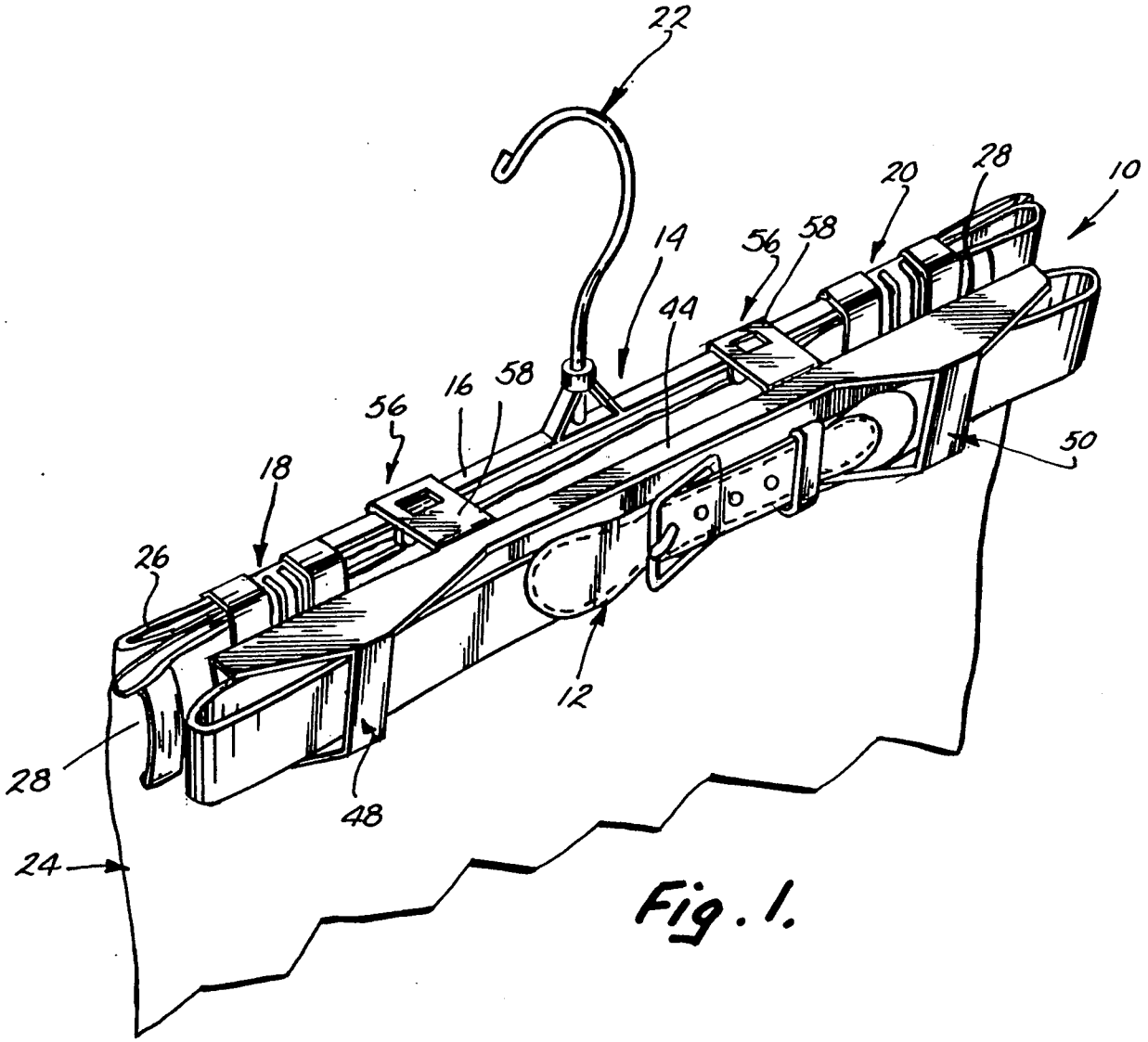
FIG. 1 is a perspective view of a garment, garment hanger and belt display hanger in accordance with the present invention.

A preferred embodiment of a belt display hanger or device in accordance with the present invention is illustrated in FIG. 1 and generally designated by the numeral 10. Device 10 receives and displays a belt 12 in conjunction with a garment hanger 14. As shown, garment hanger 14 includes a main garment hanger body 16, a pair of integral clamps 18, 20 and a central support hook 22. A garment such as a pair of slacks 24 is held by the garment hanger 14 at the garment waistband 26. Garment 24 includes a plurality of belt loops 28. Device 10, as seen in FIG. 1 displays belt 12 and positions it at the approximate location of belt loops 28.

As best seen in FIGS. 1–4, display hanger 10 includes an elongated body 40 having a back portion 42, an upper flange 44 and a lower flange 46. Generally U-shaped straps or loops 48, 50 are joined to flanges 44, 46, adjacent the ends of the elongated body 40. Straps 48, 50 are positioned and spaced along a longitudinal axis 51 of body 40. A pair of springs 52, 54 are formed integral with or joined to back portion 42 adjacent loops or straps 48, 50. The springs are in the form of fingers which extend outwardly from back portion 42 towards the straps. Back portion 42 has apertures 49, 53 which permit body 40 to be molded as a one-piece member in a two-piece mold.

A pair of attachment means 56 are provided for mounting device 10 on garment hanger body 16. Attachment means 56 are spaced along the longitudinal axis of body 40. Each attachment means 56 includes an arm or tab-like portion 58 having a lower edge joined to body 40 adjacent upper flange 44 by a hinge 60. Each arm 58 is formed with a generally U-shaped clip 62. Each clip 62 includes inner and outer flanges 64, 66 and opposed facing barbs 68.

In use, a belt 12 is slipped into the passageway 70 (FIG. 4) defined by body 40 and straps 48, 50, as shown in FIG. 1. Arms 58 of each attachment means 56 are folded downwardly and clips 62 are snapped over body portion 16 of hanger 14. The device 10 presents the belt at the same approximate position as the belt loops of the slacks 24. Straps 48, 50 simulate belt loops. The device provides a readily attachable means for displaying and selling belt accessories with slacks, pants or the like.

Figure 4:
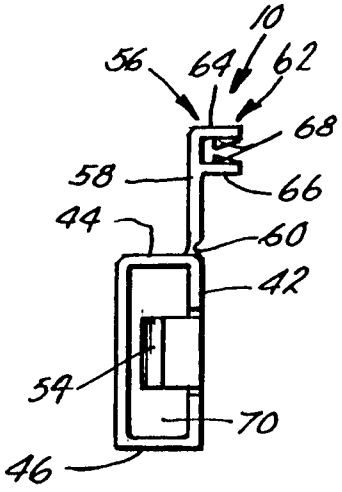
FIG. 4 is a side, elevational view of the hanger of FIG. 2.
Figure 5:
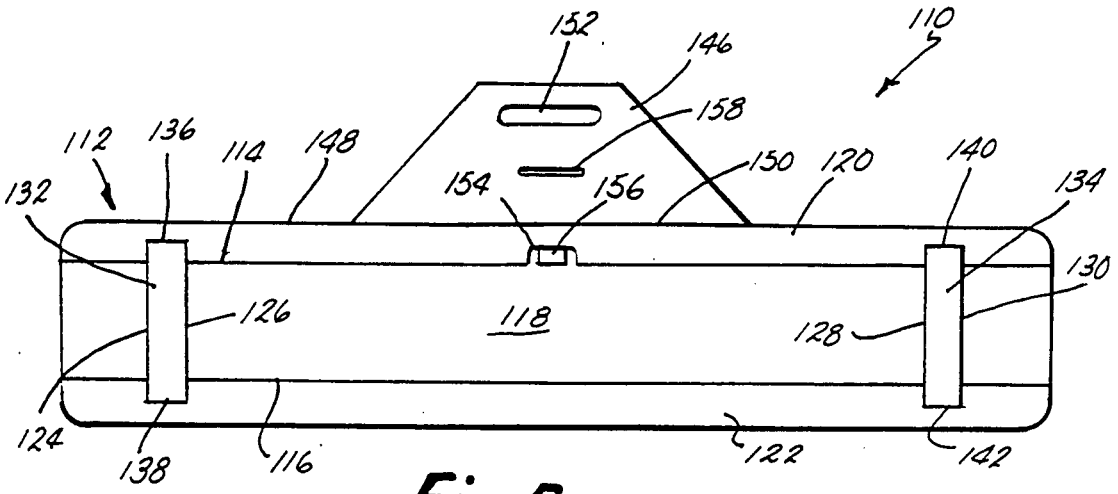
FIG. 5 is a view of an alternative embodiment formed from sheet material and shown in a flat or unfolded configuration.
Figure 6:
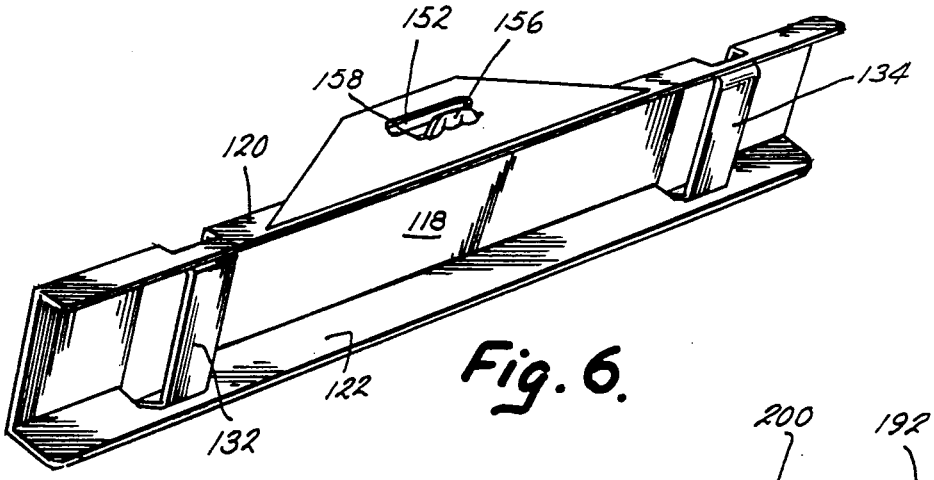
FIG. 6 is a perspective view of the embodiment of FIG. 5 folded to form the hanger.

An alternative embodiment of the present invention as illustrated in FIGS. 5 and 6 and generally designated by the numeral 110. Device 110 is a die cut blank formed from a sheet of plastic, cardboard or the like. The blank includes a body 112 having parallel fold lines 114, 116. The fold lines extend longitudinally of the body and separate the body into a back portion 118, an upper flange portion 120 and lower flange portion 122. Body 112 is slit along lines 124, 126 and along lines 128, 130 to define straps or loops 132, 134. Loop 132 is joined to the flange portions 120, 122 at fold lines 136, 138. Strap 134 is joined to the upper and lower flange portions at fold lines 140, 142. An attachment arm tab, or member 146 is joined to an upper lateral edge 148 of flange portion 120 at a fold line 150. Attachment arm 146 defines a hook receiving aperture or slot 152. In addition, body 112 is cut along a line 154 to define a tab 156. Attachment arm 146 is cut to define a tab receiving slot 158. As seen in FIG. 6, the blank shown in FIG. 5 is folded so that straps 132, 134, back portion 118 and flange portions 120, 122 define a passageway for receipt of the garment belt. Attachment arm 146 is folded backwardly onto flange portion 120 at fold line 150. Tab 156 is inserted through slot 158. Slot 158 may be slightly curvilinear and the tab 156 formed with vertical fold lines so a firmer attachment between arm 146 and body portion 112 is achieved. The embodiment of FIGS. 5 and 6 is used in substantially the same fashion as the embodiment of FIG. 1–4. In use, however, hook 22 of the garment hanger is slipped through slot or aperture 152. The device will rest on the hook boss which receives the shank portion of the hook. The belt will be presented at approximately the same position as the belt loops on the garment as in the prior embodiment.

Figure 7:
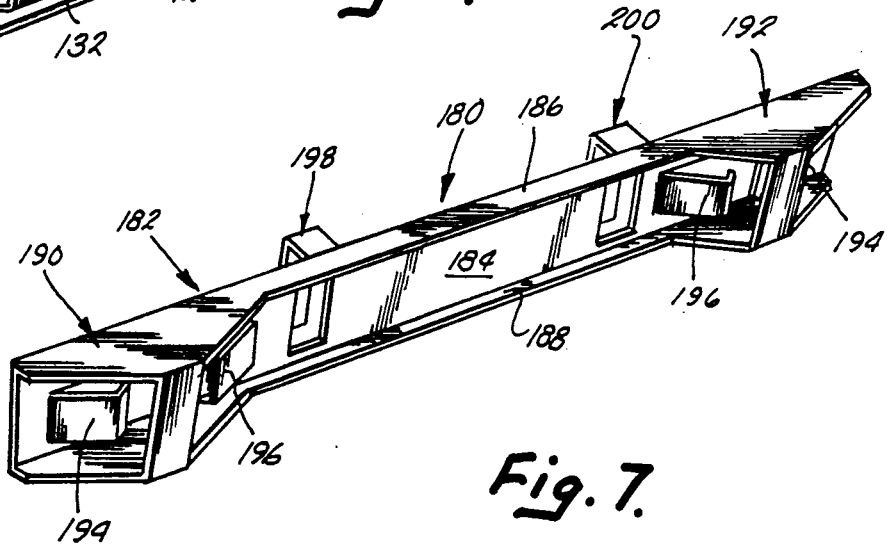
FIG. 7 is a front perspective view of a further alternative embodiment of the present invention.

FIG. 7 illustrates a still further embodiment designated by the numeral 180. As in the embodiment of FIG. 1, device 180 includes an elongated body 182 defining a back portion 184, upper and lower flanges 186, 188 and integral loop or strap portions 190, 192. Embodiment 180 includes a pair of opposed outwardly directed spring fingers 194, 196 at the strap portions. Embodiment 180 is also formed with a pair of clips or hook-like members 198, 200. Members 198, 200 extend outwardly from the back surface of back portion 184. The clips are configured so that device 180 may be clipped onto the garment waistband. In this fashion, the device is indirectly attached to the garment hanger. In the alternative, the clips may be configured so that they slip over the garment hanger body.

Figure 10:
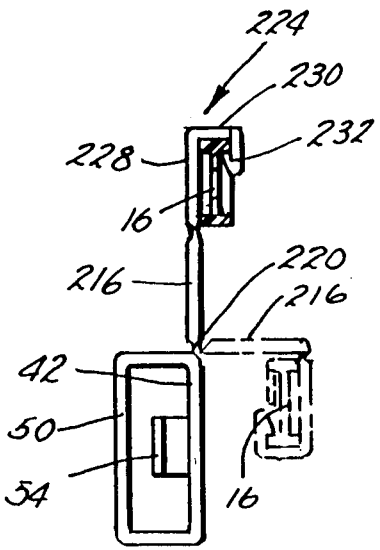
FIG. 10 is a side, elevational view of the embodiment of FIG. 8.
Figure 8:
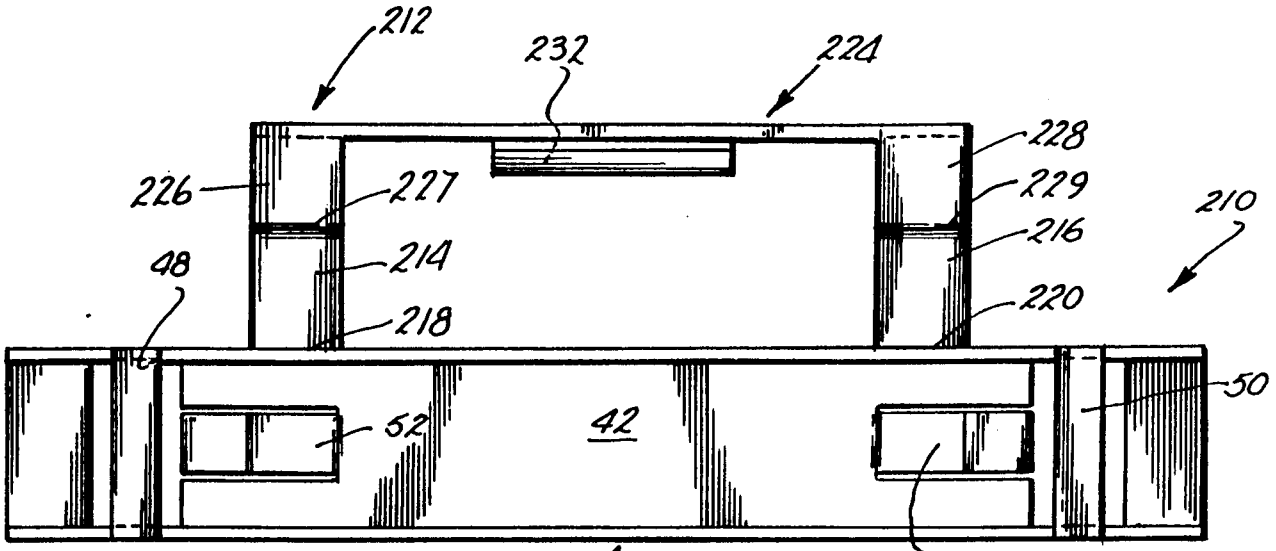
FIG. 8 is a front, elevational view of another alternative embodiment of the present invention.
Figure 9:
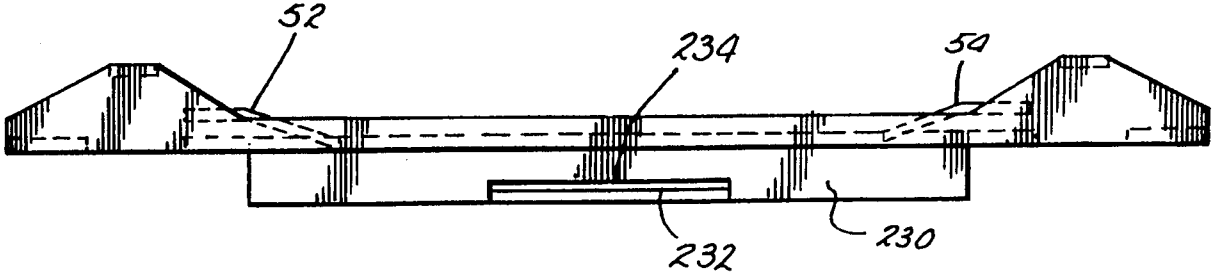
FIG. 9 is a bottom, planned view of the embodiment of FIG. 8.

A still further embodiment of the device 210 is illustrated in FIGS. 8, 9 and 10. As shown therein,, device 210 includes body 40 of the embodiment of FIGS. 2–4. An alternative attachment means 212 is provided. Attachment means 212 includes a pair of outwardly extending arms 214, 216. Arms 214, 216 are hinged to back portion 42 by integral living hinges 218, 220, respectively. A channel shaped member 224 includes side portions 226, 228 joined to arms 214, 216 by hinges 227, 229 respectively. Member 224 further includes a base 230 and an outer side wall or flange 232. Flange 232 defines an inwardly directed barb 234 (FIG. 10).

As shown, attachment means 224 provides two ways by which device 210 may be secured to garment hanger body 16. In the first form, shown in solid lines in FIG. 10, body 40 is suspended from an upper lateral edge of body 16 with flange 232 and barb 254 snap fitted over the body. In the alternative form, shown in the dotted lines in FIG. 10, arms 214, 216 are hinged perpendicular to back portion 42 and side portions 226, 228 are hinged perpendicular to arms 214, 216. Flange 232 and barb 234 are then snap fitted over a lower edge of body 16.

Figure 2:
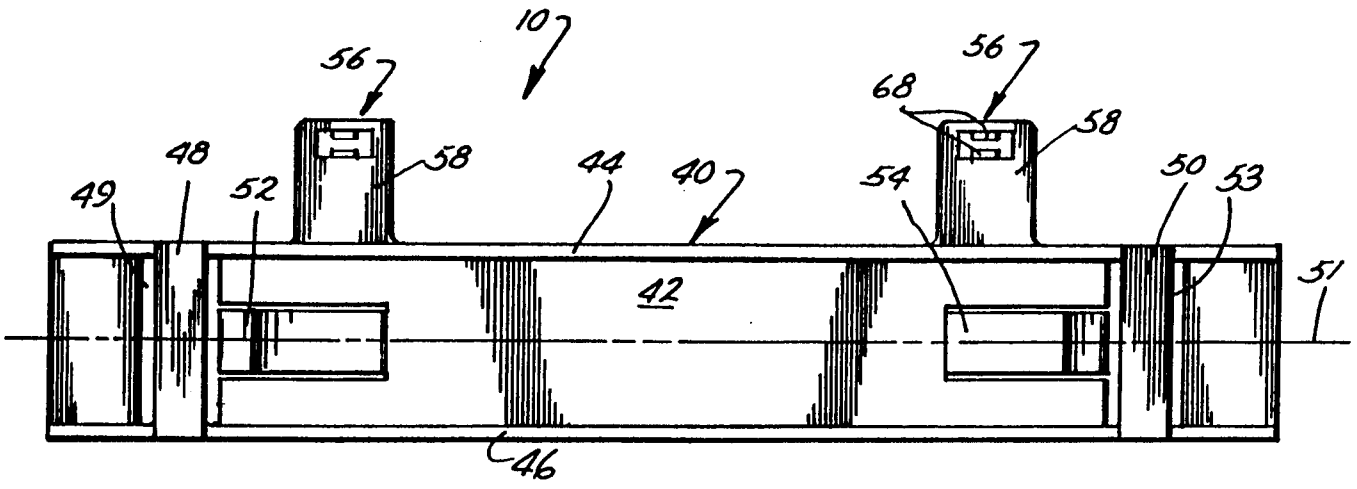
FIG. 2 is a front, elevational view of a belt display hanger in accordance with the present invention.
Figure 3:
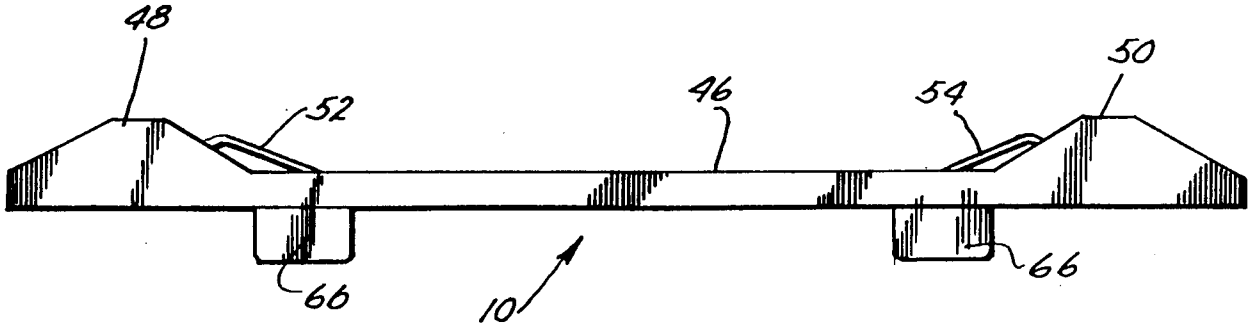
FIG. 3 is a bottom plan view of the hanger of FIG. 2.
Figure 11:
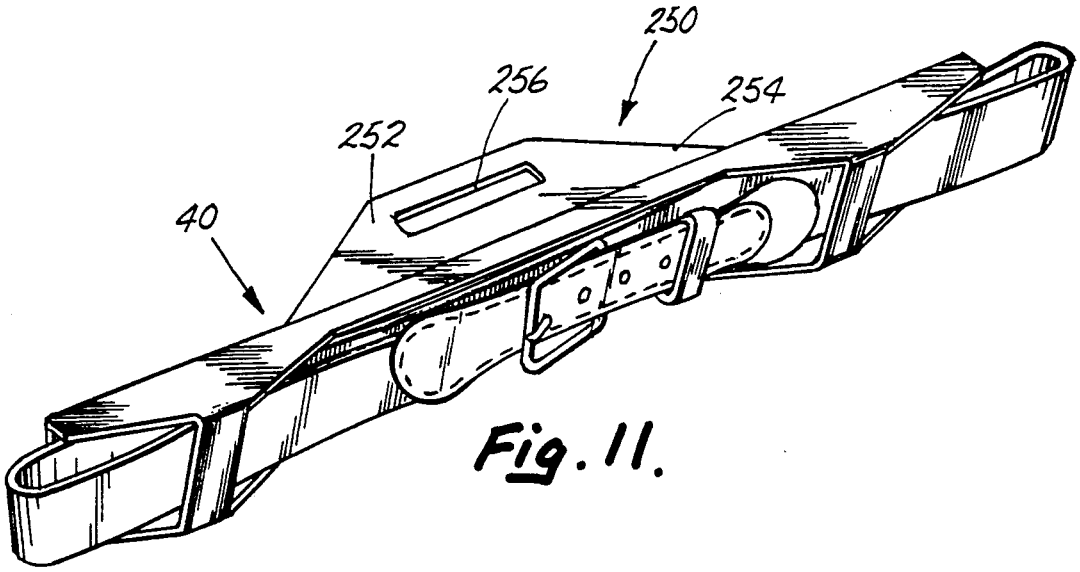
FIG. 11 is a front, perspective view of the device in accordance with the present invention shown with an alternative attachment means.

As shown in FIG. 11, body 40 of the embodiment shown in FIGS. 2–4 may be provided with a further alternative attachment means 250. Attachment means 250 includes an arm or member 252 joined to body 240 along a hinge line 254. Member 252 defines a support hook receiving slot or aperture 256. The embodiment shown in FIG. 11 is used in the same fashion as the FIG. 6 embodiment.

Figure 12:
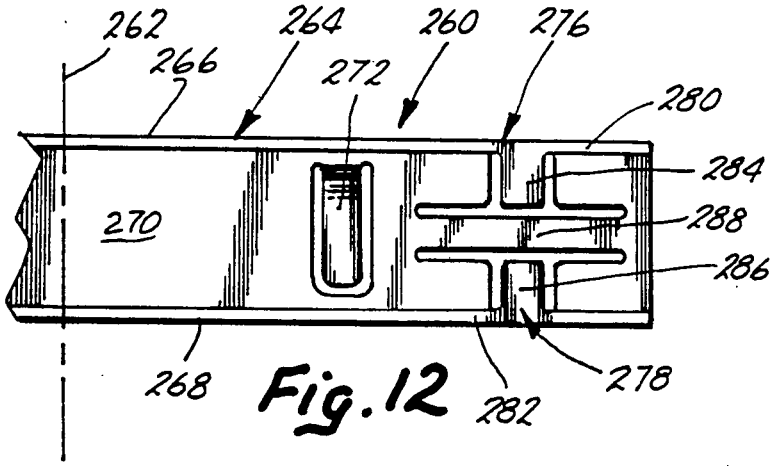
FIG. 12 is a partial, elevational view of another alternative embodiment of the hanger.

FIG. 12 illustrates the right half of a still further alternative embodiment generally designated 260. Embodiment 260 is symmetrical about a vertical center line 262 and hence only one half of the device is illustrated. Device 260 includes a body 264 having upper and lower flanges 266, 268 and a back portion 270. Clips 272 are joined to body 264. The clips are the same as clips 198, 200 of the embodiment of FIG. 7. A pair of opposed generally L-shaped portions 276, 278 are joined to flanges 266, 268 respectively. Members 276, 278 include outwardly extending legs 280, 282 and opposed right angled legs 284, 286. Legs 284, 286 define the strap or loop of the embodiment of FIG. 12. A bowed member 288 is formed in back portion 270. Member 288 extends outwardly towards legs 284, 286. The configuration of the legs and the bowed spring member 288 permits the device to be manufactured in a simple, two-piece bow.

Figure 13:
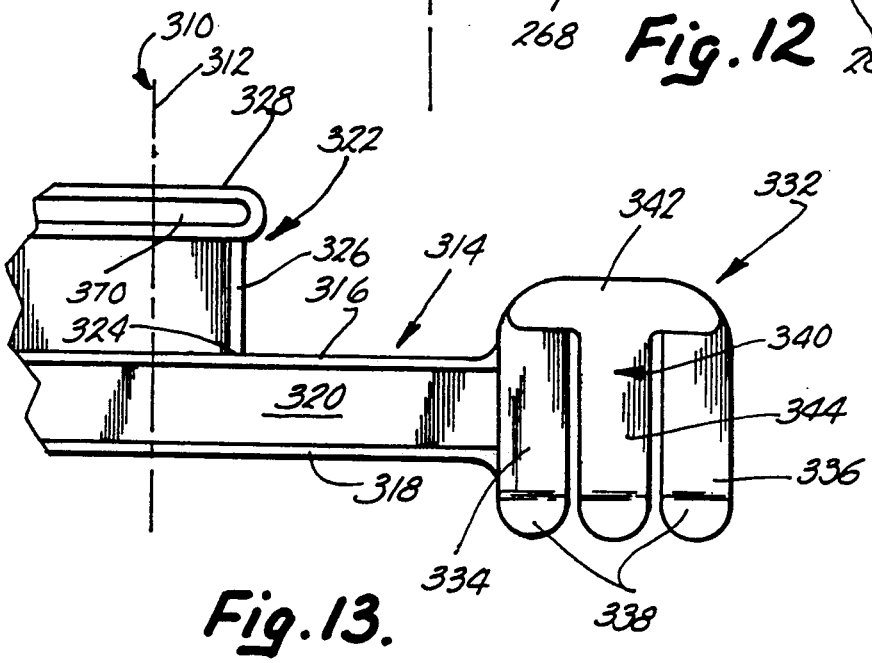
FIG. 13 is a front, elevational view of a still further alternative embodiment.

A still further alternative embodiment of the device is illustrated in FIG. 13 and generally designated by the numeral 310. Device 310 is symmetrical about a vertical center line 312 and only the right half of the device is illustrated. As shown, device 310 includes a body 314 having upper and lower beads or flanges 316, 318 and a central portion 320. An attachment member 322 is hingedly connected to body 314 along a hinge line 324. Member 322 includes a strap portion 326 joined to an end portion 328 which defines a hook receiving aperture or slot 330. A three finger clamp 332 is joined to each end of body 320. Clamp 322 includes a pair of rear fingers 334, 336 which are longitudinally spaced from each other. Each rear finger 334, 336 includes a barb 338. A front finger 340 having a generally L-shaped configuration, includes a top portion 342 and a downwardly extending portion 344. Portion 342 is joined to fingers 334, 336. Downwardly depending portion 334 is positioned longitudinally between fingers 334, 336. In the embodiment of FIG. 13, a belt is pushed or snap fitted into the clamp members 332, the belt is pressed against rear fingers 334, 336 by the front finger 340. Front finger 344 functions as a strap or loop and presents the appearance of a belt loop.

In view of the above description, those of ordinary skill in the art may envision various modifications to the belt display hanger which would not depart from the inventive concepts disclosed herein. It is expressly intended, therefore, that the above description should be considered as only that of the preferred embodiments. The true spirit and scope of the present invention may be determined by reference to the appended claims.

The embodiments of the invention in which an exclusive property or privilege is claimed are defined as follows.

I claim:

1. A device for displaying a belt with a garment on a hanger, said device comprising:

a body having a longitudinal axis;

belt mounting means on said body for removably receiving a belt, said belt mounting means defining a portion having the appearance of a belt loop; and hanger attachment means on said body for attaching the body to a garment and hanger.

2. A device as defined by claim 1 wherein said body includes a back portion and said attachment means extends generally outwardly from said back portion.

3. A device as defined by claim 2 when said attachment means comprises:

a pair of tabs joined to said body at longitudinally spaced points, said tabs each including spaced flanges extending perpendicular to said tabs, said flanges positioned to define a clip dimensioned to receive the garment hanger.

4. A device as defined by claim 3 wherein said flanges each define inwardly directed, opposed barbs configured to capture the garment hanger in a snap fitted, detent-like fashion.

5. A device as defined by claim 1 further comprising:

spring means on said body for biasing a belt into engagement with said belt mounting means.

6. A device as defined by claim 5 wherein said belt mounting means comprises:

a pair of longitudinally spaced straps joined to said body and defining a passage therewith for receipt of a belt.

7. A device as defined by claim 6 wherein said spring means comprises:

a pair of resilient fingers joined to and longitudinally spaced on said body, said fingers configured and dimensioned to engage and resiliently bias a belt into snug engagement with said straps.

8. A device as defined by claim 7 wherein said attachment means comprises:

a pair of tabs joined to said body at longitudinally spaced points, said tabs each including spaced flanges extending perpendicular to said tabs, said flanges positioned to define a clip dimensioned to receive the garment hanger.

9. A device as defined by claim 8 further including hinge means for joining said tabs to said body.

10. A device as defined by claim 9 wherein said flanges each define inwardly directed, opposed barbs configured to capture the garment hanger in a snap fitted, detent-like fashion.

11. A device as defined by claim 1 wherein said hanger attachment means comprises a pair of longitudinally spaced hooks joined to said body.

12. A device as defined by claim 11 further comprising:

spring means on said body for biasing a belt into engagement with said belt mounting means.

13. A device as defined by claim 12 wherein said belt mounting means comprises:

a pair of longitudinally spaced straps joined to said body and defining a passage therewith for receipt of a belt.

14. A device as defined by claim 13 wherein said spring means comprises:

a pair of resilient fingers joined to and longitudinally spaced on said body, said fingers configured and dimensioned to engage and resiliently bias a belt into snug engagement with said straps.

15. A device as defined by claim 1 wherein said attachment means comprises an attachment arm joined to said body, said attachment arm defining an aperture dimensioned to receive a support hook of the garment hanger.

16. A device as defined by claim 15 further comprising:

spring means on said body for biasing a belt into engagement with said belt mounting means.

17. A device as defined by claim 16 wherein said belt mounting means comprises:

a pair of longitudinally spaced straps joined to said body and defining a passage therewith for receipt of a belt.

18. A device as defined by claim 17 wherein said spring means comprises:

a pair of resilient fingers joined to and longitudinally spaced on said body, said fingers configured and dimensioned to engage and resiliently bias a belt into snug engagement with said straps.

19. A device as defined by claim 1 wherein said body comprises:

an elongated blank defining a pair of spaced, parallel, longitudinally extending fold lines dividing said blank into a back portion and upper and lower flange portions.

20. A device as defined by claim 19 wherein the upper flange portion defines a lateral edge and said attachment means comprises:

said blank defining an attachment portion joined to said lateral edge along another fold line, said attachment portion defining a hook receiving aperture.

21. A device as defined by claim 20 wherein said blank further defines a pair of spaced strap portions hingedly joined to said blank flange portions by fold lines.

22. A device as defined by claim 21 wherein said blank further defines a tab joined to the back portion of said upper flange portion and wherein said attachment portion defines a slot for receipt of said tab.

23. A device as defined by claim 1 wherein said belt mounting means comprises:

a pair of opposed, outwardly and inwardly directed, generally L-shaped fingers, said fingers along with said body defining a channel for receipt of the belt.

24. A device as defined by claim 23 wherein said body includes a resilient spring adjacent said fingers.

25. A device as defined by claim 24 wherein said hanger attachment means comprises:

a pair of longitudinally spaced hooks joined to said body.

26. A device as defined by claim 1 wherein said body is an elongated member having ends and said attachment means comprises a pair of clamp means, one at each end of said body, for receiving the belt, said clamp means each comprising:

a pair of longitudinally spaced rear fingers; and a front strap having a generally L-shaped and being joined to said rear fingers and positioned spaced from and in between said rear fingers, said fingers and said strap defining a channel-like passage for receipt of said belt.

27. A device as defined by claim 1 wherein said attachment means comprises:

a pair of longitudinally spaced arms joined to said body; and a channel shaped member joined to said arms, said member including a base and an attachment flange joined to said base, said flange defining a barb, said base and said flange dimensioned to snap over the garment hanger.

28. A device as defined by claim 27 wherein said arms and said channel shaped member are hingedly interconnected.

29. A device as defined by claim 28 wherein said arms are hinged to said body.

30. A device as defined by claim 29 further comprising:

spring means on said body for biasing a belt into engagement with said belt mounting means.

31. A device as defined by claim 30 wherein said belt mounting means comprises:

a pair of longitudinally spaced straps joined to said body and defining a passage therewith for receipt of a belt.

* * * * *